US008800449B2

(12) United States Patent
Schluckebier et al.

(10) Patent No.: US 8,800,449 B2
(45) **Date of Patent: *Aug. 12, 2014**

(54) WAD WITH IGNITION CHAMBER

(75) Inventors: David K. Schluckebier, Benton, AR (US); Kevin R. Cross, Albuquerque, NM (US); Ricky J. Buckmaster, Cabot, AR (US); Spencer D. Wildman, Prospect, KY (US)

(73) Assignee: RA Brands, L.L.C., Madison, NC (US)

( * ) Notice: Subject to any disclaimer, the term of this patent is extended or adjusted under 35 U.S.C. 154(b) by 71 days.

This patent is subject to a terminal disclaimer.

(21) Appl. No.: 13/548,464

(22) Filed: Jul. 13, 2012

(65) Prior Publication Data

US 2014/0076187 A1 Mar. 20, 2014

Related U.S. Application Data

(63) Continuation-in-part of application No. 12/606,447, filed on Oct. 27, 2009, now Pat. No. 8,220,393.

(60) Provisional application No. 61/108,678, filed on Oct. 27, 2008, provisional application No. 61/113,286, filed on Nov. 11, 2008.

(51) Int. Cl.
*F42B 14/06* (2006.01)
*F42B 7/08* (2006.01)

(52) U.S. Cl.
CPC ..... *F42B 7/08* (2013.01)
USPC ..... 102/448; 102/451; 102/453; 102/461; 102/532

(58) Field of Classification Search
USPC ..... 102/448–453, 461, 532
See application file for complete search history.

(56) References Cited

U.S. PATENT DOCUMENTS

| | | | |
|---|---|---|---|
| 219,840 | A | 9/1879 | Winchester |
| 419,220 | A | 1/1890 | Scanland |
| 681,091 | A | 8/1901 | Adamson |
| 1,659,649 | A | 2/1928 | Ernst et al. |
| 1,771,897 | A | 7/1930 | O'Neil et al. |

(Continued)

FOREIGN PATENT DOCUMENTS

| | | |
|---|---|---|
| DE | 1808779 | 6/1970 |
| FR | 1 255 993 | 2/1961 |

(Continued)

OTHER PUBLICATIONS

International Search Report mailed Feb. 3, 2010, PCT/US2009/062180, filed Oct. 27, 2009.

(Continued)

*Primary Examiner* — Michael David
(74) *Attorney, Agent, or Firm* — Womble Carlyle Sandridge & Rice, LLP

(57) ABSTRACT

A wad or basewad for ammunition includes an ignition chamber. The ignition chamber can be integrally formed with the payload wad, basewad, or battery cup or can be attached to the payload wad, basewad, or battery cup. The ignition chamber communicates with a primer of the ammunition to receive and contain the primer blast for at least an initial period of time. This facilitates faster initial ignition of the propellant of the ammunition, and consequently allows higher performance levels to be achieved. Other advantages regarding other applications of this invention include cleaner burning loads, greater economy, and lower perceived recoil.

24 Claims, 7 Drawing Sheets

(56) References Cited

U.S. PATENT DOCUMENTS

| | | | | |
|---|---|---|---|---|
| 1,872,107 | A | 8/1932 | Bond | |
| 1,908,314 | A | 5/1933 | Brownsdon | |
| 2,476,291 | A | 7/1949 | Garber | |
| 2,665,635 | A | 1/1954 | Morel | |
| 2,788,744 | A | 4/1957 | Donner | |
| 2,953,816 | A | 9/1960 | Kidder | |
| 2,973,711 | A | 3/1961 | Clark, Jr. | |
| 2,986,998 | A | 6/1961 | Clark, Jr. | |
| 3,022,731 | A | 2/1962 | Yeomans, Jr. | |
| 3,022,734 | A | 2/1962 | Kidder | |
| 3,053,185 | A | 9/1962 | Oberfell et al. | |
| 3,058,420 | A | 10/1962 | Tanner et al. | |
| 3,095,817 | A | 7/1963 | Clark, Jr. | |
| 3,120,807 | A | 2/1964 | Lyon | |
| 3,138,102 | A | 6/1964 | Meyer et al. | |
| 3,180,265 | A | 4/1965 | Rybak | |
| 3,191,534 | A | 6/1965 | Vecchiotti | |
| 3,211,100 | A | 10/1965 | Clark, Jr. | |
| 3,215,076 | A | 11/1965 | Foote et al. | |
| 3,217,648 | A | 11/1965 | Foote et al. | |
| 3,221,658 | A | 12/1965 | Devaux | |
| 3,234,877 | A | 2/1966 | Herter | |
| 3,262,392 | A | 7/1966 | Becker et al. | |
| 3,266,421 | A | 8/1966 | Comerford | |
| 3,279,375 | A | 10/1966 | Herter | |
| 3,280,745 | A | 10/1966 | Mattarelli | |
| 3,285,174 | A | 11/1966 | Moehlman et al. | |
| 3,289,586 | A | 12/1966 | Horn et al. | |
| 3,298,313 | A | 1/1967 | Comerford | |
| 3,299,813 | A | 1/1967 | Rickey | |
| 3,323,456 | A * | 6/1967 | Rothman | 102/346 |
| 3,402,664 | A | 9/1968 | Cramer | |
| 3,420,178 | A | 1/1969 | Rempel | |
| 3,422,762 | A | 1/1969 | Clark, Jr. | |
| 3,427,920 | A | 2/1969 | Clark, Jr. | |
| 3,469,527 | A | 9/1969 | Pace | |
| 3,503,332 | A | 3/1970 | De Gregorio | |
| 3,507,220 | A * | 4/1970 | McClure | 102/463 |
| 3,507,221 | A | 4/1970 | Grolly | |
| 3,565,010 | A | 2/1971 | Sahlmann | |
| 3,598,054 | A | 8/1971 | Webb et al. | |
| 3,653,326 | A | 4/1972 | Howsam et al. | |
| 3,662,683 | A | 5/1972 | Merritt | |
| 3,670,650 | A | 6/1972 | McCaffrey et al. | |
| 3,707,915 | A | 1/1973 | Kerzman | |
| 3,720,171 | A | 3/1973 | Hubbard | |
| 3,721,197 | A | 3/1973 | Hughes et al. | |
| 3,722,420 | A | 3/1973 | Herter | |
| 3,727,557 | A | 4/1973 | Starcevich | |
| 3,750,579 | A | 8/1973 | Bellington | |
| 3,750,580 | A | 8/1973 | Nomura et al. | |
| 3,788,224 | A | 1/1974 | Merritt | |
| 3,804,019 | A | 4/1974 | Hurley | |
| 3,812,784 | A | 5/1974 | Herter | |
| 3,835,783 | A | 9/1974 | Curran | |
| 3,974,775 | A | 8/1976 | Kerzman et al. | |
| 3,978,794 | A | 9/1976 | Fiocchi | |
| 4,004,522 | A | 1/1977 | Furniss et al. | |
| 4,103,621 | A | 8/1978 | Fackler | |
| 4,151,799 | A | 5/1979 | Jackson | |
| 4,164,903 | A | 8/1979 | Bouza | |
| 4,220,090 | A | 9/1980 | Fackler | |
| 4,291,625 | A | 9/1981 | Stagg, Jr. | |
| 4,295,426 | A | 10/1981 | Genco et al. | |
| 4,307,664 | A | 12/1981 | Vollers | |
| 4,452,144 | A | 6/1984 | Maki | |
| 4,553,481 | A | 11/1985 | Ricci | |
| 4,574,701 | A | 3/1986 | Fiocchi | |
| 4,587,905 | A | 5/1986 | Maki | |
| 4,627,356 | A | 12/1986 | Buczkowski | |
| 4,669,385 | A | 6/1987 | Maki | |
| 4,676,170 | A | 6/1987 | Roster | |
| 4,733,613 | A | 3/1988 | Bilsbury et al. | |
| 4,773,329 | A | 9/1988 | Bilsbury | |
| 4,776,279 | A | 10/1988 | Pejsa | |
| 4,782,759 | A | 11/1988 | Hawk | |
| 4,815,388 | A | 3/1989 | Schluckebier et al. | |
| 4,860,661 | A | 8/1989 | Bock et al. | |
| 4,970,959 | A | 11/1990 | Bilsbury et al. | |
| D314,806 | S | 2/1991 | Cole | |
| 5,105,713 | A | 4/1992 | Wirgau | |
| 5,171,934 | A | 12/1992 | Moore | |
| 5,214,238 | A | 5/1993 | Young | |
| 5,235,915 | A | 8/1993 | Stevens | |
| 5,239,928 | A | 8/1993 | Ricci | |
| 5,339,743 | A | 8/1994 | Scarlata | |
| 5,347,932 | A | 9/1994 | Gardner et al. | |
| 5,471,931 | A | 12/1995 | Gardner | |
| 5,623,118 | A | 4/1997 | Jackson | |
| 5,792,979 | A | 8/1998 | Pietro | |
| 5,837,927 | A | 11/1998 | Buenemann, Jr. | |
| 5,861,572 | A | 1/1999 | Schuermann | |
| 5,970,878 | A | 10/1999 | Gardner | |
| 5,979,330 | A | 11/1999 | Cornell | |
| 6,067,909 | A | 5/2000 | Knoster, Jr. | |
| 6,161,482 | A | 12/2000 | Clark | |
| 6,164,209 | A | 12/2000 | Best et al. | |
| 6,260,484 | B1 | 7/2001 | Billings | |
| 6,367,388 | B1 | 4/2002 | Billings | |
| 7,481,167 | B2 * | 1/2009 | Engel et al. | 102/451 |
| 8,220,393 | B2 * | 7/2012 | Schluckebier et al. | 102/448 |
| 2004/0069177 | A1 | 4/2004 | Klein | |
| 2005/0039627 | A1 | 2/2005 | Zanoletti | |
| 2005/0188882 | A1 | 9/2005 | Diller | |
| 2007/0012212 | A1 | 1/2007 | Sheaffer | |
| 2010/0101444 | A1 | 4/2010 | Schluckebier et al. | |
| 2014/0076187 | A1 * | 3/2014 | Schluckebier et al. | 102/448 |

FOREIGN PATENT DOCUMENTS

| | | |
|---|---|---|
| FR | 1255993 | 3/1961 |
| FR | 78417 | 7/1962 |
| FR | 1534004 | 7/1968 |
| FR | 2343218 | 9/1977 |
| FR | 2 568 001 | 1/1986 |
| FR | 268 217 | 8/1993 |
| IT | 427344 | 9/1948 |
| WO | WO 95/10752 | 4/1995 |

OTHER PUBLICATIONS

Written Opinion mailed Feb. 3, 2010, PCT/US2009/062180, filed Oct. 27, 2009.

International Search Report mailed Mar. 5, 2010, PCT/US2010/022523, filed Jan. 29, 2010.

Written Opinion mailed Mar. 5, 2010, PCT/US2010/022523, filed Jan. 29, 2010.

International Search Report dated Oct. 9, 2013 for PCT/US2013/049715, 4 pages.

Written Opinion dated Oct. 9, 2013 for PCT/US2013/049715, 4 pages.

* cited by examiner

WAD WITH IGNITION CHAMBER

CROSS REFERENCE TO RELATED APPLICATIONS

The present Patent Application is a continuation-in-part of U.S. patent application Ser. No. 12/606,447, filed Oct. 27, 2009, which is a formalization of previously filed, co-pending U.S. Provisional Patent Application Ser. No. 61/108,678, filed Oct. 27, 2008, and U.S. Provisional Patent Application Ser. No. 61/113,286, filed Nov. 11, 2008, by the inventors named in the present Application. This Patent Application claims the benefit of the filing date of the United States Patent Application and the Provisional Patent Applications cited above according to the statutes and rules governing provisional patent applications, particularly 35 U.S.C. §119(a)(i) and 37 C.F.R. §1.78(a)(4) and (a)(5). The specification and drawings of the United States Patent Application and the Provisional Patent Applications referenced above are specifically incorporated herein by reference as if set forth in their entireties.

FIELD OF THE INVENTION

The present invention generally relates to shotshells with other applications related to systems requiring similar performance enhancements. In particular, the present invention relates to improvements in wads and/or basewads for shotshells, muzzle loading or specialty centerfire sabots and/or pusher wads, and other systems requiring similar performance characteristics.

BACKGROUND OF THE INVENTION

Shotshells typically include a tubular body with a primer at one end, a propellant powder ignited by the primer, and a payload such as a series of shot pellets or a slug in front of the propellant powder. Such shotshells further typically include a shotshell wad between the propellant powder and the payload for containing the payload as it moves down barrel after firing. For example, FIG. 1A illustrates one type of conventional shotshell wad, here shown as Remington Arms Company, Inc. Model TGT12S Shotshell Wad, while FIG. 1B illustrates an additional embodiment of a conventional shotshell wad having an elongated tubular body with a series of petals or split sections that flare outwardly after firing and define a cup for containing the payload. Conventional shotshell cartridges have, however, reached a performance plateau wherein the maximum velocity for a given payload generally is restricted by the standard operating pressure limits set forth in the Sporting Arms and Ammunition Manufacturers Institute, Inc. ("SAAMI") guidelines for a given gauge and length. Such performance limitations have been observed in particular with steel loads required for use while hunting waterfowl and other similar game. Steel loads have an inherent disadvantage in performance properties resulting from the decreased density of the steel material versus similar size lead shot/loads. A lead pellet of equal size to its steel counterpart generally will contain more energy when fired at an equal velocity because its density and therefore mass will be greater. This handicap in energy levels for a given pellet size typically requires that a steel load use larger diameter pellets to ensure reasonable energy levels for game harvesting, and in doing so significantly lowers the number or volume of pellets a payload can contain, which in turn limits or hampers the effectiveness of the shotshell in use, particularly for game harvesting.

Accordingly, it can be seen that a need exists for a shotshell cartridge design that addresses the foregoing velocity restrictions and other related and unrelated problems.

SUMMARY OF THE INVENTION

Briefly described, the present invention generally relates to improvements in wads and/or basewads for use with various types of invention, including shotshell, centerfire, and rimfire ammunition, muzzle loading sabots, and/or other projectile/ammunition or firing systems that require similar performance characteristics. In one example embodiment, the invention can comprise a wad or basewad having an ignition chamber or tube that can be integrally formed with the wad or basewad or can be attached or affixed thereto. For example, the tube or ignition chamber can be formed with or attached to a basewad extending forwardly therefrom toward a gas obturating wad. Alternatively, the tube or ignition chamber can be mounted to or formed with a gas obturating wad, extending rearwardly toward the primer.

The ignition chamber can be formed in a variety of configurations and sizes, and defines a recess, chamber or cup toward or into which the primer blast is directed. The ignition chamber further can be of a length so as to contact or sealingly engage the primer, or can be spaced from the end of the primer at a location or distance sufficient to substantially direct the primer blast into the recess or chamber defined by the ignition chamber.

Upon firing, the primer blast is directed into the ignition chamber so as to contain the majority of the primer blast for an additional time. This generally aids in expediting ignition of the propellant powder by increasing the local pressure within the ignition chamber. The increased pressure generated by the containment of the primer blast within the ignition chamber or tube helps promote favorable pressure and temperature conditions and direct ember/particulate emission into the trapped propellant to enable quicker propellant ignition. The quicker propellant ignition increases the pressure further (in addition to the gas pressure generated by the primer blast) within the ignition chamber and accordingly provides an added thrust to the projectile of the ammunition system. Such added thrust in turn generally provides extra volume for the propellant to burn, effectively lowering the pressure. This further enables use of faster burning, more efficient powders to achieve higher than normal velocities while maintaining normal operating chamber pressures. Higher velocities can enable use of smaller shot sizes whose energy is more comparable to shot made from denser materials to achieve desired effectiveness. The tube or ignition chamber also can be weakened, such as by cuts or prestressing areas of the tube or ignition chamber, in order to help control and facilitate controlled failure of the tube and expedite ignition of the propellant outside the tube.

Various objects, features and advantages of the present invention will become apparent by to those skilled in the art upon reading the following detailed description, when taken in conjunction with the accompanying drawings.

DETAILED DESCRIPTION OF THE EXEMPLARY EMBODIMENTS

Figure 1A:
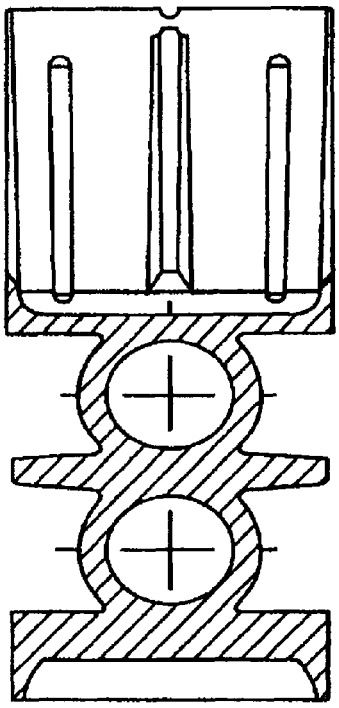
FIG. 1A (PRIOR ART)
FIGS. 1A and 1B are side elevational views, taken in cross-section, of conventional prior art shotshell wads.
Figure 1B:
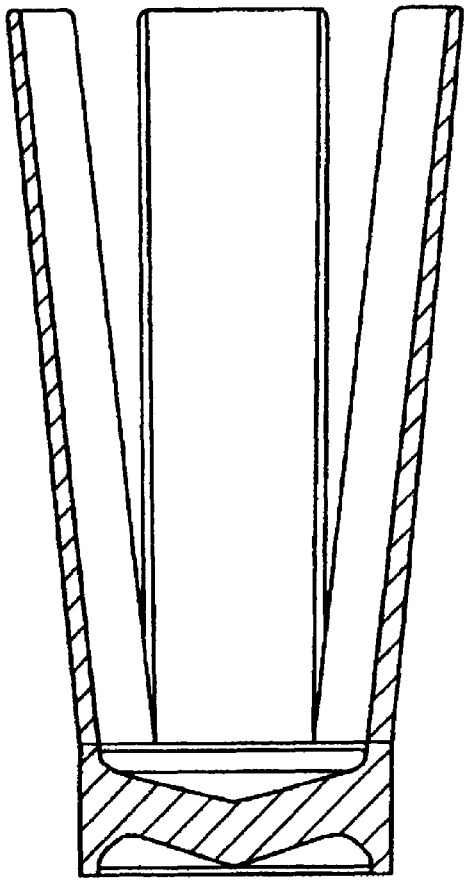
FIG. 1B (PRIOR ART)

The present invention is directed to improvements in the performance of ammunition including small arms ammunition such as shotshells, rimfire/centerfire cartridges, and other rounds, as well as for muzzle loading sabots, and other types of ammunition. Accordingly, while the present invention is illustrated herein in various example embodiments including use in shotshells, it will be understood that the wad of the present invention further can be used with a variety of other types and calibers of ammunition. Accordingly, as shown in FIGS. 2A-2B, 3A-3B and 4-5, the present invention generally can include a shotshell or similar round of ammunition 10 having a wad 11 or similar structure having an additional inner tube or ignition chamber 12 located in a rearward portion or section 13 of the shotshell or in a firearm chamber 16 (FIG. 6A) that contains the powder or propellant charge 17, which generally can be both (inside and outside of the ignition chamber or tube) for the round of ammunition 10. This ignition tube 12 can be formed in a variety of sizes and configurations such as circular, square, and/or other shapes or configurations, and typically is configured such that it generally is concentric to and is located within a practical separation/distance from the opening of the flash hole 19 of a primer 18 of the shell or round of ammunition 10. Examples of a first embodiment of the present invention can be seen in FIGS. 2A-2B.

Figure 2A:
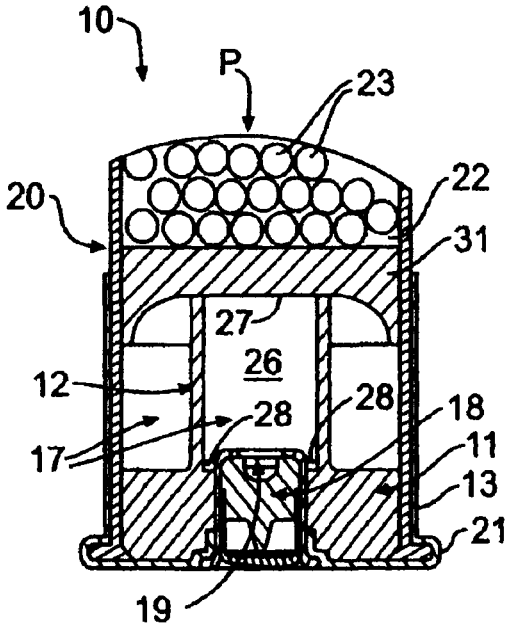
FIG. 2A is a cross-sectional view illustrating one example embodiment of a wad with an ignition chamber for a shotgun shell according to the principles of the present invention, illustrated as a component base wad.
Figure 2B:
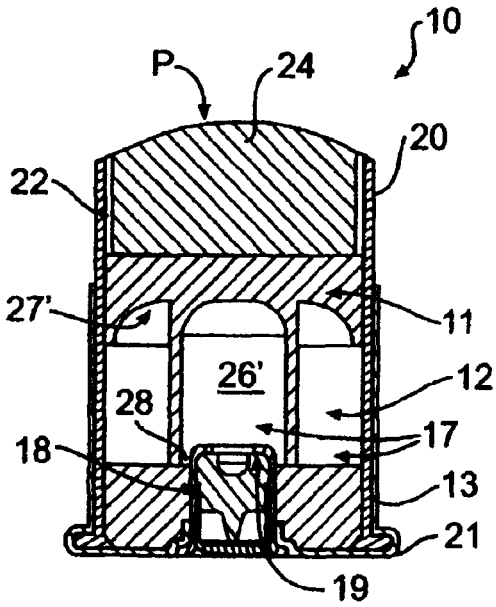
FIG. 2B is a cross-sectional view illustrating another embodiment of the present invention including a gas obturating wad with an integral ignition chamber for a shotgun shell.

As generally illustrated in FIGS. 2A and 2B, in one example embodiment of the present invention, a shotshell 10 can be provided with an ignition chamber as part of the obturating wad 11' or with an ignition chamber integrally formed with the basewad 11. The ignition chamber or tube portion is shown (12 & 12'). The shotshell typically can include a substantially 1-piece, unitary structure, or can be a multi-piece structure or construction, having a tubular hull or body 20 generally formed from plastic or similar material, that is sealed at a rearward end 13 within a head or base portion 21, typically made from brass or other metal. A primer 18 generally will be received within the head or base 21, projecting forwardly into the head and the body 20 of the shotshell, and the powder or propellant charge 17 for the shotshell generally will be located forwardly of the primer 18. In the example shown in FIG. 2B, a gas sealing or obturating wad 11' generally is shown received within the body or case 20 of the shotshell of the present embodiment, positioned in front of the propellant powder 17 and primer 18, with a chamber 22 being defined forwardly of the wad and in which a payload P, such as a shot pellet payload 23 (FIG. 2A) or a slug 24 (FIG. 2B) of the shotshell is contained. Alternatively, in FIG. 2A, a cupped basewad 11 structure is illustrated in use in the shotshell.

In the example embodiment of the present invention illustrated in FIG. 2B, the gas obturating wad 11' will be integrally formed with the tube or ignition chamber 12' extending rearwardly therefrom. This tube or ignition chamber generally defines a chamber 26' in which at least a portion of the powder or propellant of the shotshell can be received. The tube or ignition chamber also typically can be aligned along a centerline of the shotshell and will extend for a predetermined distance toward the head 21 of the shotshell 10. The length of the tube can be varied, but typically will extend from the rear 27' of the gas obturating wad 11' to a point terminating approximately in line with the forward end 28 of the primer 18. As illustrated in FIGS. 2A-2B, the tube or ignition chamber 12/12' further generally will be of a diameter approximately equivalent to a diameter of the primer 18 or otherwise sufficient to substantially receive the exploding primer gases and embers therein. By way of example only, the tube or ignition chamber can be between about 0.7-0.2 inches, though greater or lesser size and/or other configuration tubes also can be used. As a result, as the primer 18 is fired and initiates ignition of the propellant or powder 17 contained within the ignition chamber or tube of the gas obturating wad. The expanding gases from the ignition of the powder initially will be substantially contained in a more concentrated area within the tube in the shotshell.

In the alternative example embodiment of the present invention illustrated in FIG. 2A, a basewad 11 with an integral ignition chamber 12 is formed or molded within the base 21 of the shotshell, including a tube or ignition chamber 12 formed or defined therein and extending upwardly from the basewad 11 along the shotshell from the head or rear end 21 of the base, the ignition chamber 12 defining a chamber 26 and abutting or ending a short distance from the rear surface of a gas obturating wad 31 located adjacent the payload (i.e., the slug 24) of the shotshell. In this embodiment, the primer generally will be contained within the basewad so as to be concentric and integral with the tube or ignition chamber defined by the basewad, and in which at least a portion of the powder is contained. As a result, just like the other embodiment of the present invention illustrated in FIG. 2B, the actuation of the primer and initial ignition of the propellant (in the embodiment in FIG. 2A) is directed into and along the tube or ignition chamber 26 defined by the basewad 11, such that the tube or ignition chamber initially contains the primer blast after firing. As a further result, the pressures generated by the ignition of the propellant powder of the shotshell from the primer blast are substantially contained within the tube or ignition chamber at least for an initial time or moment after firing and will create further thrust to drive or accelerate the movement of the gas obturating wad and thus the payload portion of the shotshell out of the case of the shotshell and down-bore along the barrel of the shotgun.

Figure 3A:
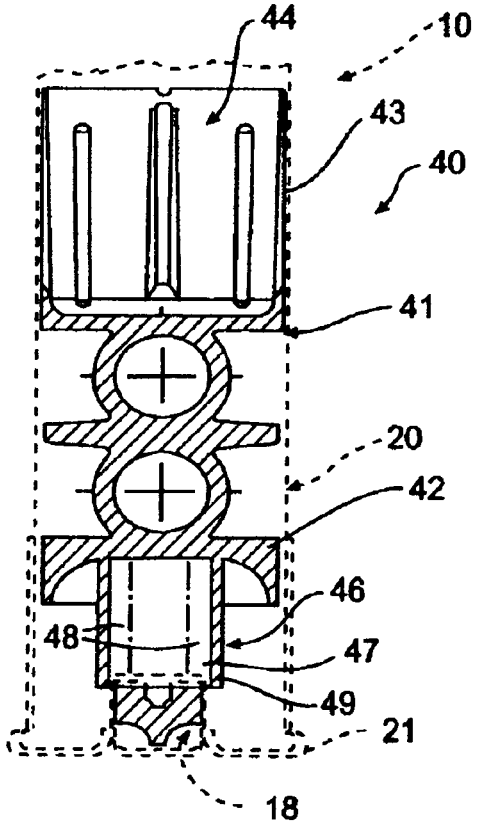
FIGS. 3A and 3B are side elevational views, taken in cross-section, of additional embodiments of shotshell wads with an ignition chamber according to the present invention incorporated into conventional shotshell wads.

FIG. 3A illustrates still another embodiment of the shotshell wad 40 with ignition chamber according to the principles of the present invention as applied to a conventional shotshell wad construction, here shown as a Remington Arms Company Inc. Model TGT12S Shotshell Wad, having a body 41 including a lower section of base 42, and an upper section 43 defining a cup 44 in which a payload such as shot pellets or a slug (not shown) can be received. As indicated by dashed lines 20, the shotshell wad 40 typically can be received within a shotshell body 20 having a base or head portion 21 in which a primer 18 is received. It also will be understood by those skilled in the art, however, that substantially any shotshell wad systems such as are conventionally on the market also can be utilized with the wad system according to the present invention. As illustrated in FIG. 3A, such a conventional shotshell wad 40 can be modified according to the principles of the present invention to include a tube or ignition chamber 46 shown as being integrally formed with the sealing wad base 42 so as to extend rearwardly therefrom. The tube generally engages or communicates with the primer 18 of the shotshell, and defines a central chamber 47 or recess in which at least a portion of the propellant powder can be initially ignited by the primer upon firing so as to initially contain and enable further effectiveness of the primer blast.

Figure 6B:
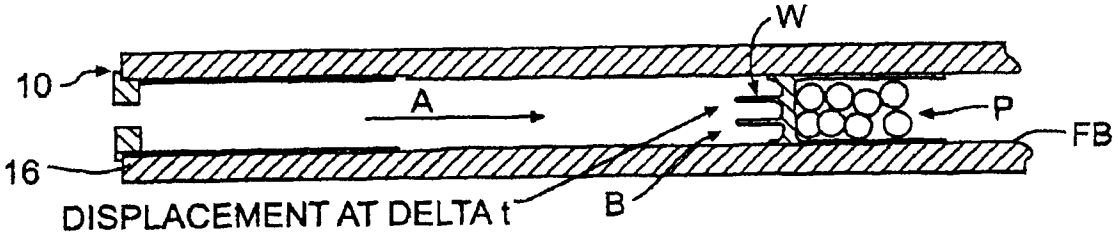
FIG. 6B is a cross sectional view illustrating a conventional wad at a down barrel location at a similar time increment after beginning the interior ballistic cycle, as shown in FIG. 6A.
Figure 6A:
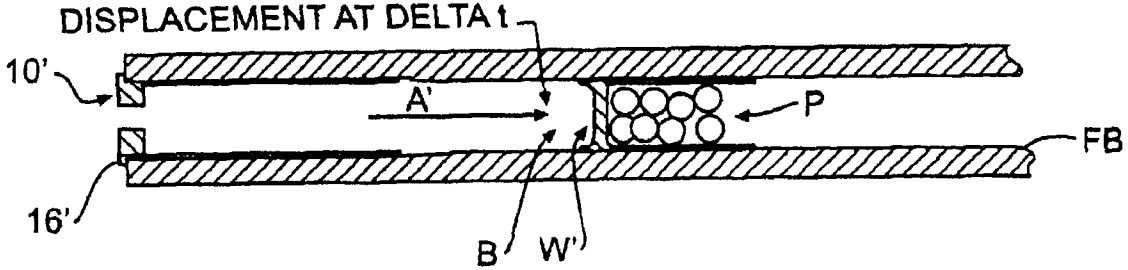
FIG. 6A is a cross sectional view of a wad according to the present invention traveling down the barrel after beginning the interior ballistic cycle.

It is also possible, as illustrated by the phantom lines 48 shown in FIG. 3A, to include grooves or cuts formed into the wall 49 of the tube or ignition chamber 46 of the shotshell wad 40 of the present embodiment so as to facilitate a substantially symmetric failure of the tube or ignition chamber 46 at a desired rate. Such a generally controlled failure of the tube or ignition chamber will further help expedite the ignition of the remaining propellant powder outside of the tube or ignition chamber. As a result, the remaining propellant powder outside the tube or ignition chamber can be initiated or ignited more uniformly so as to ensure faster and/or more complete ignition of the entire propellant powder charge within the shotshell, thus further enhancing the acceleration or driving of the payload down-bore and out of the shotshell, as illustrated in FIGS. 6A-6B discussed below.

Figure 3B:
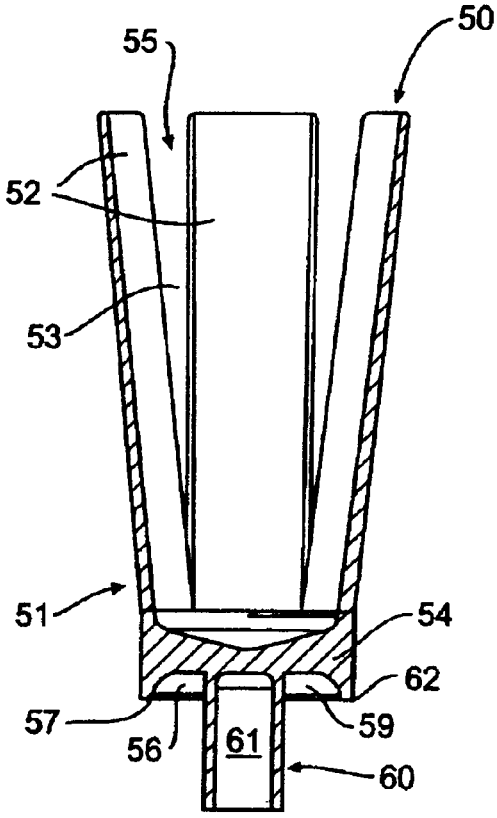

FIG. 3B illustrates a further conventional type or style wad 50 such as for a shotshell, modified according to the principles of the present invention. The shotshell wad shown in FIG. 3B generally includes an elongated tubular body 51 formed from the series of petals or sections 52 defining a cup 55 and having slits or cuts 53 therebetween to enable the side walls or petals 52 of the wad 50 to flare outwardly after firing. The side walls of the wad body 51 terminate at a lower end at a cap or base 54, which extends rearwardly therefrom and generally includes a recess or cavity 56 formed in its rear surface 57. The shotshell wad 50 further includes an additional tube or ignition chamber 60 formed in the base 54 of the wad 50, extending rearwardly therefrom and defining a recess or chamber 61. The tube or ignition chamber 60 is generally shown as being substantially centrally located along the base, with the outer edges 62 of the recess or cavity formed in the base of the wad, overlapping or extending thereabout as indicated in FIG. 3B.

Additionally, while the embodiments shown in FIGS. 3A and 3B both illustrate the use of a molded tube or ignition chamber integrally formed with the base of the wad, it also is possible to form the tube or ignition chamber separately from the wad, and attach it thereto via adhesives, welding or other attachment means, or to form the tube such as with a basewad as illustrated in FIG. 2A, wherein the tube will engage the rear portion of the wad in a contact or friction fit.

Figure 4:
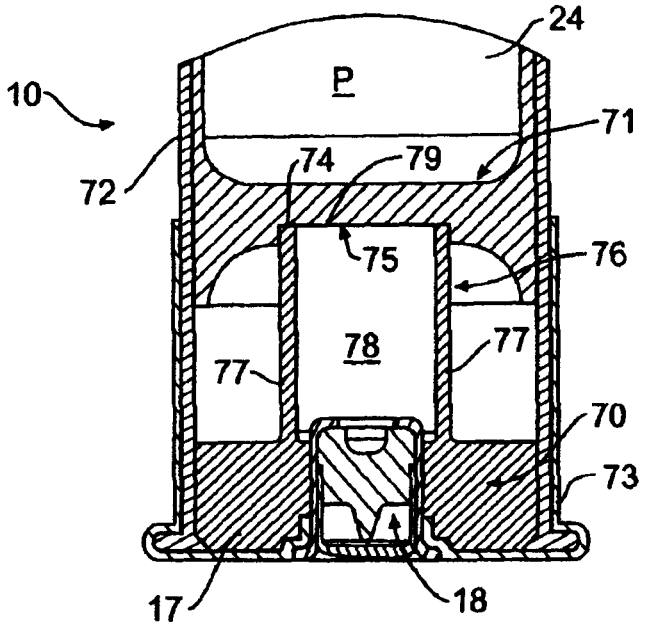
FIG. 4 is a side elevational view, taken in cross section, of a further embodiment of the present invention, illustrating a shotshell basewad with an ignition chamber coupled to a gas obturation wad.

FIG. 4 illustrates still a further design for a round of ammunition or shell 10 having a basewad 70 and gas sealing or gas obturating wad 71 incorporating the principles of the present invention. In this embodiment, the gas obturating wad 71 and basewad 70 can be used with a shotshell 10 or similar round of ammunition having a shell body 72 and a base or head 73, and can be formed so as to couple together, rather than being specifically molded together. For example, as indicated in FIG. 4, the gas obturating wad 71 can be formed with a recess or notch 74 that is aligned with the upper end 75 of a tube or ignition chamber 76 formed in the basewad 70. The tube or ignition chamber 76 includes a sidewall 77 that can be formed in cylindrical or other configurations and defines a recess or internal chamber 78 aligned with the primer 18 of the round of ammunition or shotshell. As the gas obturating wad is mounted within the shotshell case, this recess or notch portion 74 can be urged into tight frictional engagement with the upper end 75 of the tube or ignition chamber 76 so as to couple the gas obturating wad 71 to the basewad 70 as indicated in FIG. 4. As a result, a better initial seal, indicated at 79 can be created, without having to mold the tube or ignition chamber of the basewad to the gas obturating wad, thus allowing for higher gas pressures upon firing before rupturing or failure of the tube or ignition chamber. Still further, various other attachment methods or means, such as use of adhesives, friction fitting or other, similar attachments also can be used to send and otherwise maintain contact between the wad and basewad.

Figure 5:
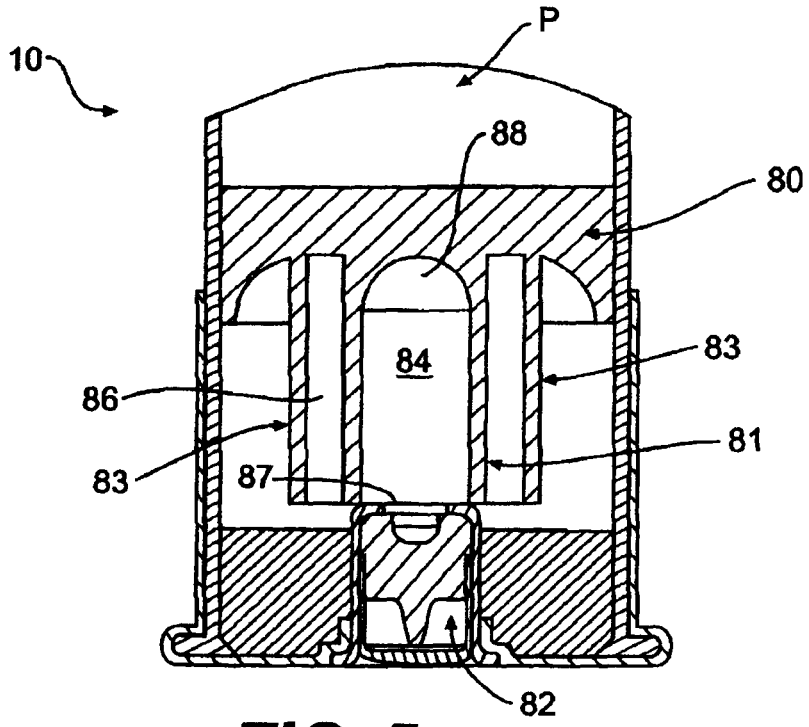
FIG. 5 is a side elevational view, taken in a cross section of yet another embodiment of the present invention with a concentric tube arrangement of the ignition chamber.

FIG. 5 illustrates yet another embodiment of the wad 80 with an ignition chamber according to the principles of the present invention. In this embodiment, a gas obturating wad 80 is formed with a first or primary tube or ignition chamber 81, which is shown as generally being centrally aligned or located with respect to a primer 82 of the round of ammunition 10. One or more secondary tubes or chambers 83 further are defined concentrically spaced from and surrounding the primary tube or ignition chamber 81. The secondary tube(s) or chamber(s) 83 define recesses that contain propellant which ignites after the inner tube initial pressurization is relieved by the tube rupture and axial wad movement. The second chamber helps further contain the primer/propellant pressurization as needed to enable the desired rate of increase in volume behind the gas obturating wad 80 after firing. As further indicated in FIG. 5, the proximal or rearward end 87 of the primary ignition chamber 81 can be in engagement with the primer 82, including engaging the primer in a friction fit, while the forward or distal end 88 of the primary ignition chamber 81 can have a curved or hemispherical configuration to further assist in focusing the pressure waves from the primer blast.

In the initial stages of firing, when the primer blast pressure waves send hot embers into the powder, the tube or ignition chamber 12/12' (FIGS. 2A-2B), 46 (FIG. 3A), 60 (FIG. 3B), 76 (FIG. 4), and 81 (FIG. 5) of the wad of each of the embodiments of the present invention acts as a small pressure vessel and helps direct the embers/powder into a confined volume. The increased pressure inside the tube or ignition chamber(s) of such wads results in favorable pressure and temperature conditions for powder ignition and is coupled with the tubes ability to confine and direct the particulate emission, allowing for improved initial gas generation. By introducing these favorable ignition conditions early on (prior to peak chamber pressure), the payload (i.e. shot, slug or other projectile) experiences a larger acceleration that results in increased volume behind the payload P as it moves down the bore B of the barrel FB of a firearm, as shown by arrow A in FIG. 6A. Such an increase in the volume along the bore B of the barrel FB at a greater rate reduces the peak pressure experienced inside the bore as compared to normal shotshell interior ballistic cycles.

For example, FIGS. 6A and 6B illustrate the displacement of a payload P/P' of a round of ammunition being fired utilizing a wad W with the tube or ignition chamber according to the present invention versus a conventional design wad W'. FIG. 6A illustrates the down-bore displacement of the payload P fired from a round of ammunition, such as a shotshell, as it proceeds along the barrel of a firearm after firing including the wad with ignition chamber of the present invention, while FIG. 6B illustrates the relative position of the payload P' fired from a round of ammunition using the conventional wad at the same time "Delta T."

As shown by the comparison of FIGS. 6A and 6B, the volume opened is greater for the present invention and allows for performance and economical advantages as discussed further below. With initial testing, peak chamber pressure decreases of up to 56% have been realized. Initial testing has also shown that reductions in tube diameter and consequently volume therewithin have shown the largest chamber pressure reductions with all other variables held constant.

This type of system allows for gains in several distinctive areas related to the performance of ammunition, such as a shotshell. The first most obvious is a gain in velocity. By decreasing the peak pressure experienced in the system, more powder can be loaded to restore the loss of pressure and a significant increase in velocity can result. This immediately provides opportunities for performance improvements on the steel loads commonly used to hunt waterfowl because of environmental concerns. As mentioned earlier steel loads are at a disadvantage because their density is lower than that of lead, meaning that a pellet of lead identical in size and shape to one of steel going the same velocity will have more energy because its mass will be higher. By increasing the speed of the steel load we can restore that missing energy to help compensate for the difference in mass/weight and help bridge the lethality gap between lead and steel shot pellets. It is general knowledge that a hunter needs to use a larger shot size (i.e., 2 shot sizes) when steel is compared to lead to provide equivalent downrange energy. With the present invention, the velocity of a 12 Ga 3¼ oz steel load has been found to be increased by over 200 fps, which, upon inspection of downrange performance reduces the gap more closely to 1 shot size when steel is used as compared to lead. For example, if you used to use a #4 lead shot size to kill ducks prior to the Federal ban on using lead shot for waterfowl, equivalent energy in conventional shotshells would be with #2 steel but with the present invention, you can now use a #3 steel for equivalent downrange energy which carries the advantage of more pellets in the payload as well.

A second potential gain is in the ability to use faster, cleaner burning powders. Often in magnum loads, and steel loads, very slow burning powder is required to keep the peak pressures within safe operating limits while maintaining desired velocities. These powders often tend to be harder to ignite and leave more undesirable residue in the firearms. Because of the pressure drop associated with the tube/ignition chamber in the system, these loads can use the faster, cleaner burning powders that would otherwise produce unsafe pressure levels. Now, existing loads using the present invention will leave less residue in firearms.

Another gain is in possible powder charge weight savings associated with the use of faster burning powders mentioned above. These powders are often more energetic and require a lower charge weight to achieve the same velocity. Faster burning powders tend to more completely burn vs. slow burning powders, thus increasing efficiency. However, obtaining equal velocities with a faster powder comes at the expense of pressure resulting in a system that is no longer within safe operating pressures. With the help of the present invention, such operating efficiency and safety can be maintained, and thus powder weight savings can be realized. Obviously, powder weight savings directly effects and reduces product cost for greater economical advantage.

Still a further potential benefit is in a felt recoil reduction. Changing the initial payload displacement and the rate of chamber pressure rise has increased the overall time of the interior ballistic cycle. Obtaining similar payload performance over a longer timeframe will change the perception of recoil. The "kick" delivered over a longer timeframe will feel less sharp. This advantage could have significant applications in target loads where often the velocities of the payloads are dictated in the rules such as trap or skeet. Here we can achieve the same velocity at a lower peak pressure by spreading the work done over time providing the shooter with a more comfortable round to fire. With the large number of shotshells fired by one person in typical competitions, the shooter fatigue will be less with reduced recoil.

Given a specific load, any one or a combination of the above discussed advantages can be implemented for enhancing the product in specific applications.

FIGS. 2A-2B and 4-5 show a conceptual view of shotshell with an ignition chamber incorporated into either an obturating wad or a base wad in a shotshell. Typically, other wad components will be placed between this obturating wad and the payload (shot, buckshot, or slug). However, an advantage of the system of the present invention is that it can be incorporated into any wad system on the market as shown with a modified Remington TGT12S target wad in FIG. 3A, and another variant of a steel shot wad in FIG. 3B. Preferably the length of the tube can match the height necessary to substantially eliminate any gap between the base wad and beginning of the tube, although some gap can still be provided/used. Testing has shown that the best pressure reductions will occur in this scenario but even with a gap, reductions of up to 30% can be achieved. One possible variation would include a tube with a collapsible or telescoping tube bottom so the height can automatically be adjusted as the wad is seated into the shell during loading regardless of the powder height. It would also be possible to include grooves or cuts into the wall of the tube (as noted with respect to the embodiment of FIG. 3A) so that a symmetric failure of the cup can be created to help to ignite the remaining powder outside the cup more uniformly. Initial testing shows that the tube can rupture violently and in some cases, asymmetrically.

Alternatively, the tube walls could be thickened to increase their ability to withstand pressure of expanding/igniting gases in the ignition chamber for better initial ignition. Additionally, alternate materials that would add strength to the ignition chamber or alternatively provide brittleness to control the consistency of the ignition event further can be used. A variety of materials to make the ignition chamber such as metals, plastics, cellulose based products, etc., are envisioned as being possible. Typically, lower cost materials will be seen as providing a better economic choice, such as high and low density polyethylene or similar materials in preferred initial embodiments.

The wad and/or basewad could also be geometrically designed to couple together by friction as shown in FIG. 4 to create a better initial seal forcing higher pressures before the tube bursts. Alternate fastening configurations other than by friction (i.e., use of adhesive materials, etc. . . . ) also are possible.

Still further, alternate ignition chamber geometries can be envisioned to provide either equivalent or enhanced ignition. Instead of a circular cross section, other polygonal or star shaped cross sections may be advantageous for reducing the volume further to obtain greater thrust on the base of the wad. Also, instead of a consistent ignition chamber cross section, a substantially continuous curved surface, such as shown in FIG. 5, changing in diameter axially may be advantageous for focusing the primer pressure wave to a specific point. Furthermore, a nozzle geometry could be used to optimize thrust.

Figure 7C:
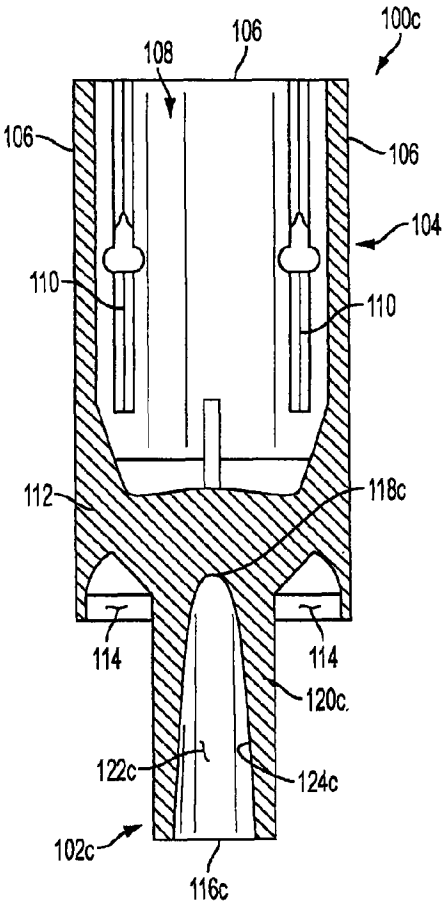
FIGS. 7A-7C illustrate various configurations of an ignition chamber with a focused thrust design.
Figure 7B:
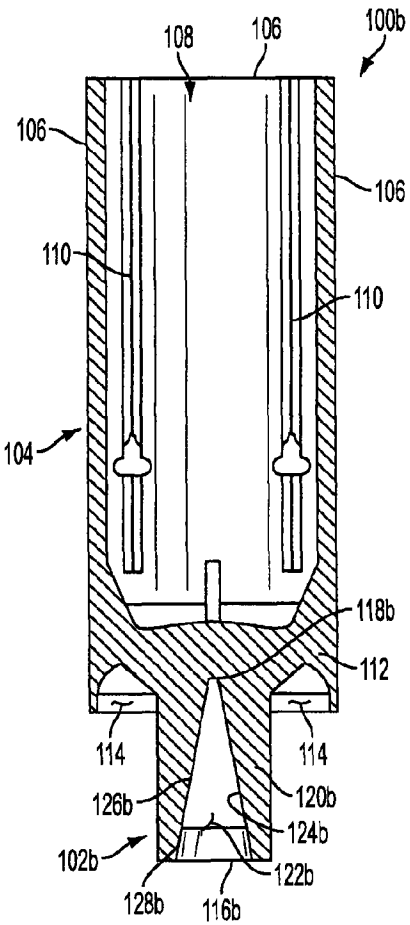
Figure 7A:
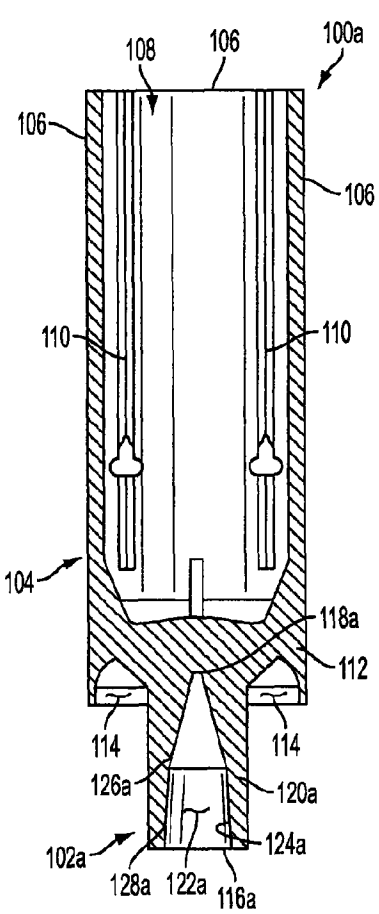

For example, FIGS. 7A-7C illustrate embodiments of an ignition chamber with different nozzle geometries. Each of FIGS. 7A, 7B, and 7C illustrates a longitudinal cross-section of a respective gas obturating or payload wad 100*a*, 100*b*, 100*c*, each having a respective integrally formed ignition chamber 102*a*, 102*b*, 102*c* extending rearwardly therefrom. Each of the wads 100*a*, 100*b*, 100*c* generally includes an elongated tubular body 104 formed from a series of petals or sections 106 defining a cup 108 for at least partially containing a payload (e.g., shot pellets, a slug, etc.). The cup 108 can include slits or cuts 110 extending between the petals 106 to enable the petals 106 to flare outwardly after firing. The side walls of the wad body 104 terminate at a lower end at a cap or base 112, which generally can include a recess or cavity 114 formed therein and extending at least partially about the circumference or periphery of the base. While the bodies 104 of the wads 100*a*, 100*b*, 100*c*, shown in FIGS. 7A-7C, are shown with generally similar features, it will, however, be understood by those skilled in the art that any of these features could be omitted or otherwise configured and/or arranged without departing from the disclosure.

As shown in FIGS. 7A-7C, each of the ignition chambers 102*a*, 102*b*, 102*c* generally includes a respective proximal end 116*a*, 116*b*, 116*c* that can be aligned with and positioned adjacent a forward end of a primer of a firearm cartridge or shell (not shown), and a respective distal end 118*a*, 118*b*, 118*c* that is proximate the base 112 of its respective wad 100*a*, 100*b*, 100*c*. Each of the ignition chambers 102*a*, 102*b*, 102*c* further includes an ignition tube 120*a*, 120*b*, 120*c* that can be integrally formed with or affixed to the base 112 of its payload wad, generally projecting rearwardly therefrom.

As shown in FIG. 7A, in one embodiment the ignition tube 120*a* defines an ignition recess 122*a* that is open at the proximal end 116*a* for receiving a primer blast from the primer (not shown). The ignition recess 122*a* is shown in this embodiment as being widest (e.g., has a maximum cross-sectional area) at its proximal end 116*a* and generally is narrower (e.g., has a reduced or minimum cross-sectional area) at its distal end 118*a*. The nozzle geometry of the ignition chamber 102*a* further is defined by an angled or tapering interior surface 124*a* formed along the ignition tube 120*a*. This interior surface 124*a* can include a first portion 126*a* that extends from the distal end 118*a* of the ignition chamber 102*a* and can have a generally wedge or conical shape as shown in the longitudinal cross-section of FIG. 7A. The first portion 126*a* of the interior surface 124*a* gradually widens or expands at a first angle from the distal end 118*a* toward the proximal end 116*a*. A second portion 128*a* of the interior surface extends at a second angle from the first portion 126*a* to the proximal end 116*a* of the ignition chamber. Accordingly, the ignition recess 122*a* gradually widens in a dual angle configuration from the narrowest portion at the distal end 118*a* to the widest portion at the proximal end 116*a*.

As shown in FIG. 7A, the first and second angles of the first portion 126*a* and second portion 128*a*, respectively, can be different. For example, the first angle of the first portion 126*a* is shown in FIG. 7A as being larger than the second angle of the second portion 128*a*. Alternatively, the second angle can be larger than or substantially the same as the first angle. In one embodiment, the ignition tube 120*a* also can have a generally circular transverse cross-section so that the ignition recess 122*a* is generally cone-shaped. Alternatively, the ignition tube 120*a* can have any suitable cross-sectional shape.

In another embodiment shown in FIG. 7B, the ignition tube 120*b* can define an ignition recess 122*b* that is generally similar to the ignition recess 122*a* of FIG. 7A, except while the first and second portions 126*a*, 128*a* of the interior surface 124*a* are about the same length, the first portion 126*b* of the interior surface 124*b* of the ignition recess 122*b* is shown in this embodiment as being somewhat longer than the second portion 128*b*. In another alternative embodiment, the second portion of the interior surface of an ignition recess can be longer than the first portion. In addition, in yet another alternative embodiment, the ignition recess can widen from the distal end to the proximal end at a consistent slope (e.g., a single angle configuration), or the interior surface can include more than two portions having different angles (e.g., the multiple portions can have increasing angles or decreasing angles as the ignition recess widens, the multiple portions can have alternating angles, etc.).

In a further embodiment shown in FIG. 7C, the ignition tube 120*b* can define an ignition recess 122*c* having a shaped—i.e., conical or substantially curved interior surface 124*c* so that the longitudinal cross-section of the ignition recess 122*c* generally forms a parabola or other shaped/focused surfaced at its distal end 118*c*. The ignition recess can be alternatively shaped, arranged, configured, and/or disposed without departing from the disclosure.

In operation, the wad 100*a* can be incorporated into a shotshell or another type of ammunition so that the proximal end 116*a* of the ignition chamber 102*a* of the wad generally is aligned with and adjacent a forward end of a primer of an ammunition shell or cartridge. A propellant (not shown) can be contained in the ignition recess 122*a* and in the base of the shell or cartridge exterior to the ignition tube 120*a*. Upon ignition of the primer, the primer blast can exit the forward end of the primer and will be received in the ignition chamber 102*a*. Accordingly, the primer blast will ignite the propellant in the ignition chamber 102*a*, and the shape of the ignition recess 122*a* can help focus and contain the primer blast in the ignition chamber, including reducing or compressing the volume of the primer blast, which can foster faster ignition and ignition of more of the propellant within the ignition chamber, and resultingly provide an enhanced initial pressure in the ignition chamber prior to and/or during the ignition of the propellant to the exterior of the ignition chamber.

In one embodiment, the propellant in the ignition chamber also can be different from the propellant exterior to the ignition chamber. For example, one propellant can be a fast-burning propellant that burns more quickly (producing higher initial pressure) and generally burns more completely, and the other propellant can be a relatively slow-burning propellant that may help avoid exceeding pressure tolerances in a chamber of a firearm. The faster burning propellant can be used within the ignition chamber, or outside the ignition chamber, with the slower burning propellant used in the ignition chamber, as needed depending upon the desired burning and performance characteristics of the shotshell or cartridge. In the illustrated embodiments, the ignition chambers 102*b*, 102*c* can operate in a similar fashion as the ignition chamber 102*a* to provide different focusing of the primer blast in the ignition chamber.

Figure 8:
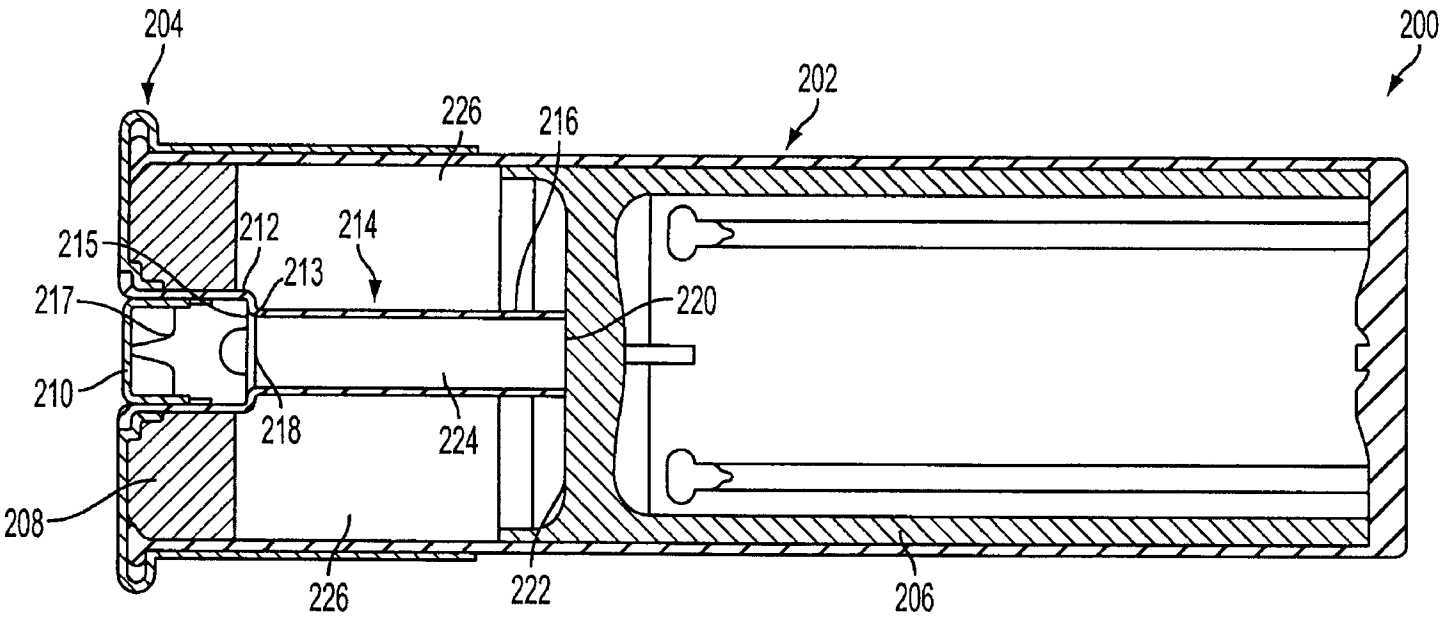
FIG. 8 is a cross-sectional view of yet another alternative embodiment of the present invention, illustrating the ignition chamber being formed as part of a battery cup of the primer.

FIG. 8 illustrates a longitudinal cross-section of a further alternative embodiment of a round of ammunition 200 (e.g. a shotshell) having a shell body 202, a base 204, and a gas obturating or payload wad 206. A primer cup 210 having a battery cup 212 is received with the base 204 of the round/shell 200. A paper foil 215 is assembled forward of an anvil 217 in the primer cup 210. The forward end 213 of the battery cup further generally can be extended with an elongated ignition chamber 214. The payload wad 206 can be alternatively configured without departing from the disclosure. A rearward end of the shell body 202 is disposed in the base (brass) 204 with the primer cup 210 and the battery cup 212 mounted within the base 204 and extending forwardly from the rearward end of the base 204. The primer cup 210, also can generally include a primer, the paper foil 215, and the anvil 217, as well as other features, which can be received in the extended battery cup 212 with the ignition chamber 214.

As shown in FIG. 8, the ignition chamber 214 comprises an ignition tube 216 that can be integrally formed with the battery cup 212, or mounted thereto so that a proximal end 218 of the ignition chamber 214 is aligned with and extends/projects from the forward end 213 of the primer cup 210 adjacent the battery cup 212. The ignition tube 216 can extend from the battery cup 212 toward the payload wad 206 and, in one embodiment, a distal end 220 of the ignition chamber 214 can abut a rearward surface 222 of the base of the payload wad 206.

A first propellant 224 generally can be contained in the ignition tube 216 and a second propellant 226 can be contained in the shell body 202 between the base wad 208 and the payload wad 206 along the exterior of the ignition tube 216. The first propellant 224 and the second propellant 226 can include the same propellant material, or, alternatively, can be different propellant materials. For example, the first propellant 224 can be a slower-burning propellant, and the second propellant 226 can be a relatively faster-burning propellant, or the first propellant can be a faster-burning propellant with the second propellant comprising the slower-burning propellant. The propellant can be otherwise configured and/or arranged without departing from the disclosure.

Exemplary slower burning propellants can include the St. Marks 500 series of powders (e.g., the St. Marks 502 or 504 powders) manufactured by General Dynamics, or the AMS-10, AMS-20, or AMS-30 powders manufactured by Alliant Techsystems Inc. Faster burning propellants can include St. Marks 474 powder manufactured by General Dynamics or other powders with speeds between those of the Alliant 375 to AMS-40 powders manufactured by Alliant Techsystems Inc, for example. These propellants are included by way of example only. Any suitable propellants can be used inside and outside the ignition chamber without departing from the scope of the disclosure.

Any of the features of the various embodiments of the disclosure as discussed above can be combined with, replaced by, or otherwise configured with other features of other embodiments of the disclosure without departing from the scope of this disclosure. Further, it is noted that the ignition chambers of the various embodiments can be incorporated into any suitable style or configuration of ammunition. The wad and shell body styles and configurations described above are included by way of example. Additionally, the ignition chambers of the various embodiments could be formed separately to be affixed to a payload wad, a base wad, or a battery cup, or to be otherwise disposed in a round of ammunition.

Most of the explanations above were directed toward shotshell applications of the present invention. However other applications are envisioned. For example, other types of ammunition could be used, such as a sabot or pusher wad for muzzle loading applications, which could easily incorporate the ignition chamber system according to the present invention into the gas obturating end thereof. Faster burning black powder types could be used to obtain higher velocities than conventional practice. In still further potential embodiments, the primer battery cup could be extended to accomplish the same goal. In such embodiments, the primer battery cup could be configured similar to an open ended flash tube and function similarly to the embodiment shown in FIG. 2A. Instead of the integral tube/basewad configuration, a normal basewad could house a long version of a shotshell primer to provide a substantially equivalent configuration.

It will be understood by those skilled in the art that while the present invention has been discussed above with respect to particular embodiments of the present invention, various additions, modifications and/or changes can be made thereto without departing from the spirit and scope of the invention.

We claim:

1. A round of ammunition, comprising:

a primer having a forward end;

a wad disposed opposite to the primer;

an ignition chamber disposed between the primer and the wad, with a proximal end of the ignition chamber aligned with and located adjacent the forward end of the primer configured for receiving a primer blast therein.

2. The round of ammunition of claim 1, further comprising a first propellant disposed in at least the ignition chamber and a second propellant disposed at least along an exterior of the ignition chamber rearwardly of the wad.

3. The round of ammunition of claim 2, wherein the first propellant is different from the second propellant.

4. The round of ammunition of claim 1, wherein the primer is at least partially disposed in a battery cup, and the proximal end of the ignition chamber extends from the battery cup, terminating at a distal end of the ignition chamber adjacent a rearward face of the wad.

5. The round of ammunition of claim 4, wherein the ignition chamber comprises an ignition tube, and wherein the ignition tube is integrally formed with the battery cup at the proximal end of the ignition chamber.

6. The round of ammunition of claim 1, further comprising a secondary tube concentric with and exterior to the ignition chamber, the secondary tube defining at least one recess between the ignition chamber and the secondary tube.

7. The round of ammunition of claim 6, wherein a propellant is disposed in at least the ignition chamber, and the at least one recess between the ignition chamber and the secondary tube.

8. The round of ammunition of claim 6, wherein the ignition chamber comprises an ignition tube, and wherein the secondary tube and the ignition tube are integrally formed with the wad.

9. The round of ammunition of claim 1, wherein the ignition chamber comprises an ignition tube defining an ignition recess extending between a distal end of the ignition chamber adjacent the wad and the proximal end of the ignition chamber, the ignition recess having a minimum cross-sectional area at the distal end of the ignition chamber and a maximum cross-sectional area at the proximal end of the ignition chamber.

10. The round of ammunition of claim 9, wherein the ignition tube comprises an interior surface having a first portion extending from the distal end of the ignition chamber at a first angle, and a second portion extending from the first portion to the proximal end of the ignition chamber at a second angle.

11. The round of ammunition of claim 10, wherein the first angle is greater than the second angle.

12. The round of ammunition of claim 1, wherein the ignition chamber is integrally formed with the wad.

13. The round of ammunition of claim 1 and wherein said ignition chamber comprises a tube having a substantially cylindrical, square, rectangular or polygonal cross-sectional configuration.

14. The found of ammunition of claim 1, wherein the wad comprises a base wad and the ignition chamber further comprises an ignition tube integrally formed with the base wad.

15. An ignition chamber configured for a round of ammunition having a wad disposed opposite to a primer, the ignition chamber comprising:

a distal end configured to be disposed adjacent the wad; and a proximal end configured to be aligned with and disposed adjacent a forward end of the primer configured for receiving a primer blast therefrom.

16. The ignition chamber of claim 15, comprising an ignition tube, wherein the ignition tube is integrally formed with a battery cup of the primer located at the proximal end of the ignition chamber, so that the forward end of the primer communicates with the proximal end of the ignition chamber.

17. The ignition chamber of claim 15, comprising an ignition tube at least partially received in a secondary tube to define at least one recess between the ignition tube and the secondary tube, the secondary tube being generally concentric with the ignition tube.

18. The ignition chamber of claim 17, wherein the secondary tube at least partially defines an interior surface of an outer chamber, and each of the ignition chamber, the secondary tube, and the outer chamber is adapted to receive a propellant.

19. The ignition chamber of claim 15, comprising an ignition tube defining an ignition recess extending between the distal end of the ignition chamber and the proximal end of the ignition chamber, wherein the ignition recess comprises a minimum cross-sectional area adjacent the distal end of the ignition chamber and a maximum cross-sectional area adjacent the proximal end of the ignition chamber.

20. The ignition chamber of claim 19, wherein the ignition tube comprises a curved interior surface, with the ignition recess having a generally parabolic longitudinal cross-section.

21. The ignition chamber of claim 19, wherein the ignition recess is generally conical.

22. The ignition chamber of claim 19, wherein the ignition tube comprises an interior surface having a first portion extending from the distal end of the ignition chamber at a first angle, and a second portion extending from the first portion to the proximal end of the ignition chamber at a second angle.

23. The ignition chamber of claim 15, and wherein said ignition chamber comprises having a substantially cylindrical, square, rectangular or polygonal cross-sectional configuration.

24. The ignition chamber of claim 15, and wherein the wad comprises a base wad and the ignition chamber further comprises an ignition tube integrally formed with the base wad.

* * * * *

UNITED STATES PATENT AND TRADEMARK OFFICE

CERTIFICATE OF CORRECTION

PATENT NO. : 8,800,449 B2
APPLICATION NO. : 13/548464
DATED : August 12, 2014
INVENTOR(S) : David K. Schluckebier et al.

It is certified that error appears in the above-identified patent and that said Letters Patent is hereby corrected as shown below:

In the Specification

Column 7, line 36 - "...of a 12 Ga 3 1/4 oz steel load has been found..." should read "...of a 12 Ga 3" 1 1/4 oz steel load has been found...".

Signed and Sealed this
Eighteenth Day of November, 2014

Michelle K. Lee

Michelle K. Lee
*Deputy Director of the United States Patent and Trademark Office*